United States Patent [19]

Bierhoff

[11] Patent Number: 4,764,041

[45] Date of Patent: Aug. 16, 1988

[54] MULTIFUNCTIONAL CASSETTE WITH WEB BRAKE FOR A PRINTER

[75] Inventor: Waltherus C. J. Bierhoff, Eindhoven, Netherlands

[73] Assignee: U.S. Philips Corporation, New York, N.Y.

[21] Appl. No.: 8,110

[22] Filed: Jan. 23, 1987

Related U.S. Application Data

[63] Continuation of Ser. No. 780,549, Sep. 26, 1985, abandoned.

[30] Foreign Application Priority Data

May 30, 1985 [NL] Netherlands ..... 8501540

[51] Int. Cl.[4] ..... B41J 11/58

[52] U.S. Cl. ..... 400/618; 400/208; 400/234; 400/613; 188/82.8; 226/147

[58] Field of Search ..... 400/208, 234, 236, 236.1, 400/236.2, 613, 618, 611; 40/471, 518; 188/65.1, 82.8, 82.84, 136; 226/127, 128, 147, 149, 151; 242/75.2, 75.4, 99, 198

[56] References Cited

U.S. PATENT DOCUMENTS 2,416,859 3/1947 Vining et al. ..... 188/65.1
2,953,290 9/1960 Kostenko et al. ..... 226/151
4,413,919 11/1983 Applegate et al. ..... 400/234
4,448,556 5/1984 Trezise et al. ..... 400/208
4,557,617 12/1985 Richardson et al. ..... 400/208

OTHER PUBLICATIONS

*Mechanisms, Linkages and Mechanical Controls,* edited by N. P. Chironis; McGraw-Hill Book Company, NY, NY, 1965, p. 340.

*Primary Examiner*—David Wiecking
*Attorney, Agent, or Firm*—Robert T. Mayer

[57] ABSTRACT

A multifunctional cassette (1) for a printer (131), in which the cassette (1) that can be arranged in the printer (131) is provided with first, second and third chambers (31, 35, 37). The second chamber (35) and the first chamber (31) can accommodate a supply reel (59) and a takeup reel (57), respectively, for transport of a color transfer strip (55) past the printing head (143), while the third chamber (37) can comprise a supply of a data strip (41) to be transported along the printing head (143). Pins (103, 105) brake the web when the cassette is not in the printer. Whether using or not using the first and second chambers (31, 35), the multifunctional use of the cassette (1) becomes possible for different types of printers, such as black-and-white printers and color printers.

6 Claims, 9 Drawing Sheets

MULTIFUNCTIONAL CASSETTE WITH WEB BRAKE FOR A PRINTER

Figure 1:
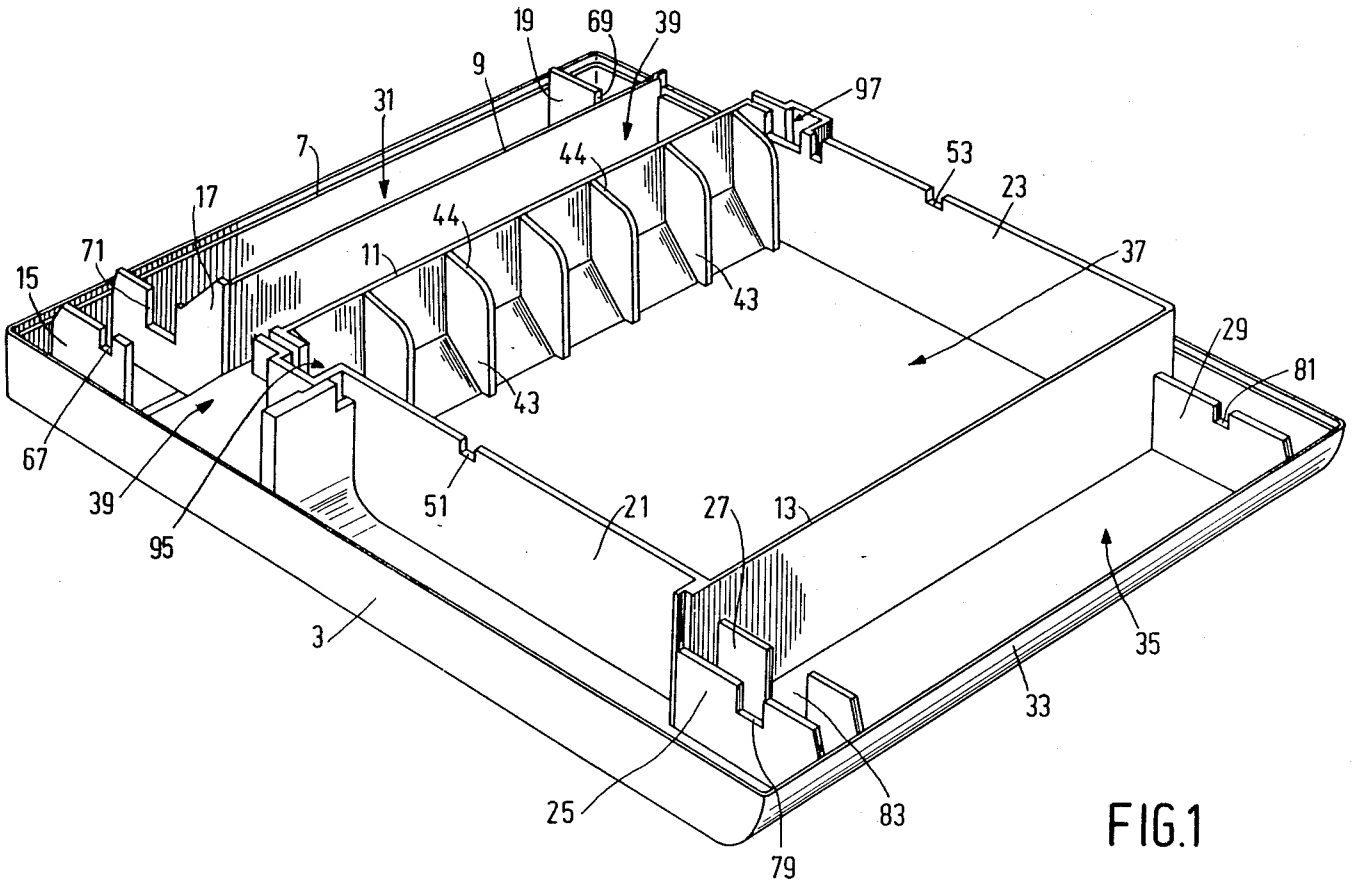

This is a continuation of application Ser. No. 780,549 filed Sept. 26, 1985, now abandoned.

The invention relates to a multifunctional cassette for a printer comprising a first chamber suitable for journalling a cylindrical take-up reel and a second chamber suitable for journalling a cylindrical supply reel parallel to the take-up reel, this cassette being provided with a window which is located between the first and the second chamber and extends from a first cassette side to an opposite second cassette side and thus forms an opening in the cassette which is accessible from two sides.

In a cassette of the kind mentioned in the opening paragraph known from British Patent Application No. 2100673, which corresponds to U.S. Pat. No. 4,496,955 after insertion of the cassette into a colour printer, a data strip is transported along the window from the outer side by transport means, in this case a transport roller, entirely arranged outside the cassette, in which a sheet of paper is clamped. The cassette itself accommodates a colour transfer strip which extends along the window from a supply reel to a take-up reel. Both strips are displaced synchronously along a printing head inserted into the window by means of separate transport means, the transport roller then also extending into the window. A disadvantage of the known cassette is that its use is limited to printing processes, in which use is made of a transfer strip. Printing arbitrarily with or without a transfer strip is not possible with the known cassette. Furthermore, the introduction of the paper into the printer, but especially the step of clamping it on the transport roller, requires a care and a skill which renders the cassette less practical for the user. The procedures required for beginning the printing process are laborious and time-consuming, as a result of which disturbances are very liable to occur. Especially for the large category of non-professional users, this is unfavourable.

The invention has for its object to provide a cassette in which the said disadvantages are avoided and which is multifunctional due to the fact that arbitrarily only a data strip or a combination of a data strip and a transfer strip is present in the cassette.

A multifunctional cassette according to the invention is for this purpose characterized in that the cassette has a third chamber suitable for storing a data strip.

Due to the fact that it is no longer required for the user to manipulate with the data strip, but that he has to work only with the not very vulnerable cassette, the initial steps for the beginning of the printing process are limited to a minimum and a considerable part of the necessary operations is mechanized. The sensitivity to disturbances is considerably reduced, which is mainly due to the fact that a large group of users has been familiar for a long time with the use of cassettes especially in audio and video apparatus.

It should be noted that U.S. Pat. No. 4,262,301 discloses a cassette for colour printers in video cameras, in which both a colour transfer strip and a number of data strips are arranged in a stack. This means that the various strips have to be separated so that a comparatively complicated separation mechanism sensitive to disturbance is required. This separation mechanism is moreover partly operated by hand.

A particular embodiment of the cassette, which is protected against undesired displacement of the data strip, is further characterized in that the third chamber is located between the first and the second chamber and between the window and the second chamber and comprises a supply of a fold-up data strip projecting to the outside through the window, while a brake for the data strip is arranged on either side of the data strip.

A further embodiment of the cassette with a combination of a data strip and a transfer strip, in which the transfer strip is continuously subjected to tensile stress, is characterized in that the cassette is provided with a take-up reel rotatable in a first bearing in the first chamber and with a supply reel rotatable in a second bearing in the second chamber with a supply of a data strip which is guided along the window and is secured with one end to the take-up reel, the transfer strip being stretched by a stretching device coupled to the supply reel and a blocking device blocking the take-up reel in a direction opposite to the winding direction.

A further embodiment of the cassette having a stretching device for the transfer strip which can be mass-produced in a simple and inexpensive manner is characterized in that the stretching device is a frictional coupling which comprises a helical spring which is slipped over a shaft to the supply reel and which has a first end bearing on a wall in the cassette and a free second end, a first part of the helical spring engaging on its inner side a first part of the shaft having a comparatively large diameter, while a second part of the helical spring is arranged so as to be free from a second part of the shaft having a comparatively small diameter.

A further embodiment of the cassette having two brakes for the data strip which can be mass-produced in a simple and inexpensive manner is characterized in that the brake is provided with a slide which is displaceable against spring force and to which is secured a frictional pin, which engages on the one hand a slope arranged in the cassette and in the switched-on condition of the brake engages on the other hand a side edge of the data strip.

A still further embodiment of the cassette suitable for a drive of the transfer strip arranged externally in a printer is characterized in that the take-up reel has secured to it a gear wheel which is accessible through an opening in the cassette.

Figure 2:
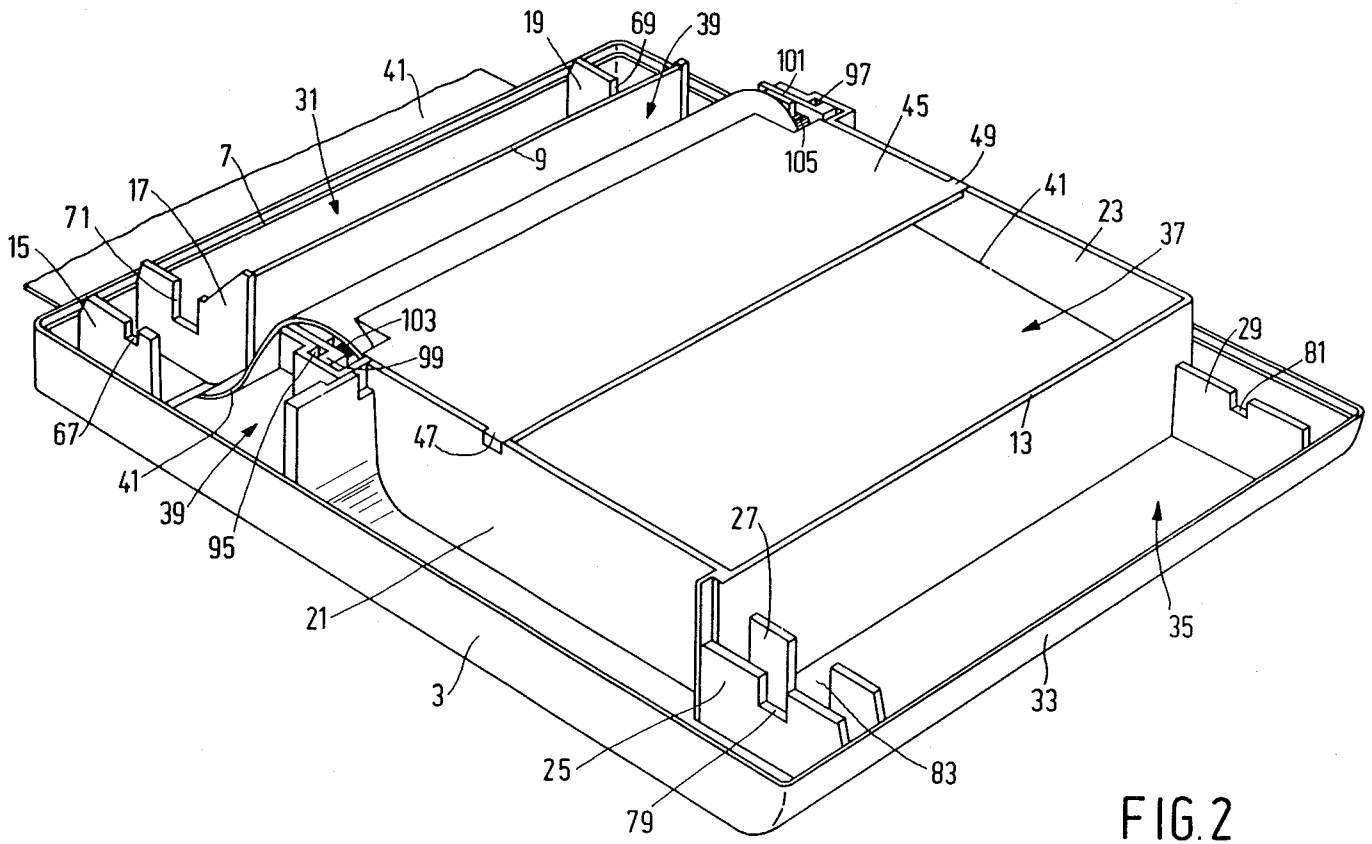
Figures 3, 4:
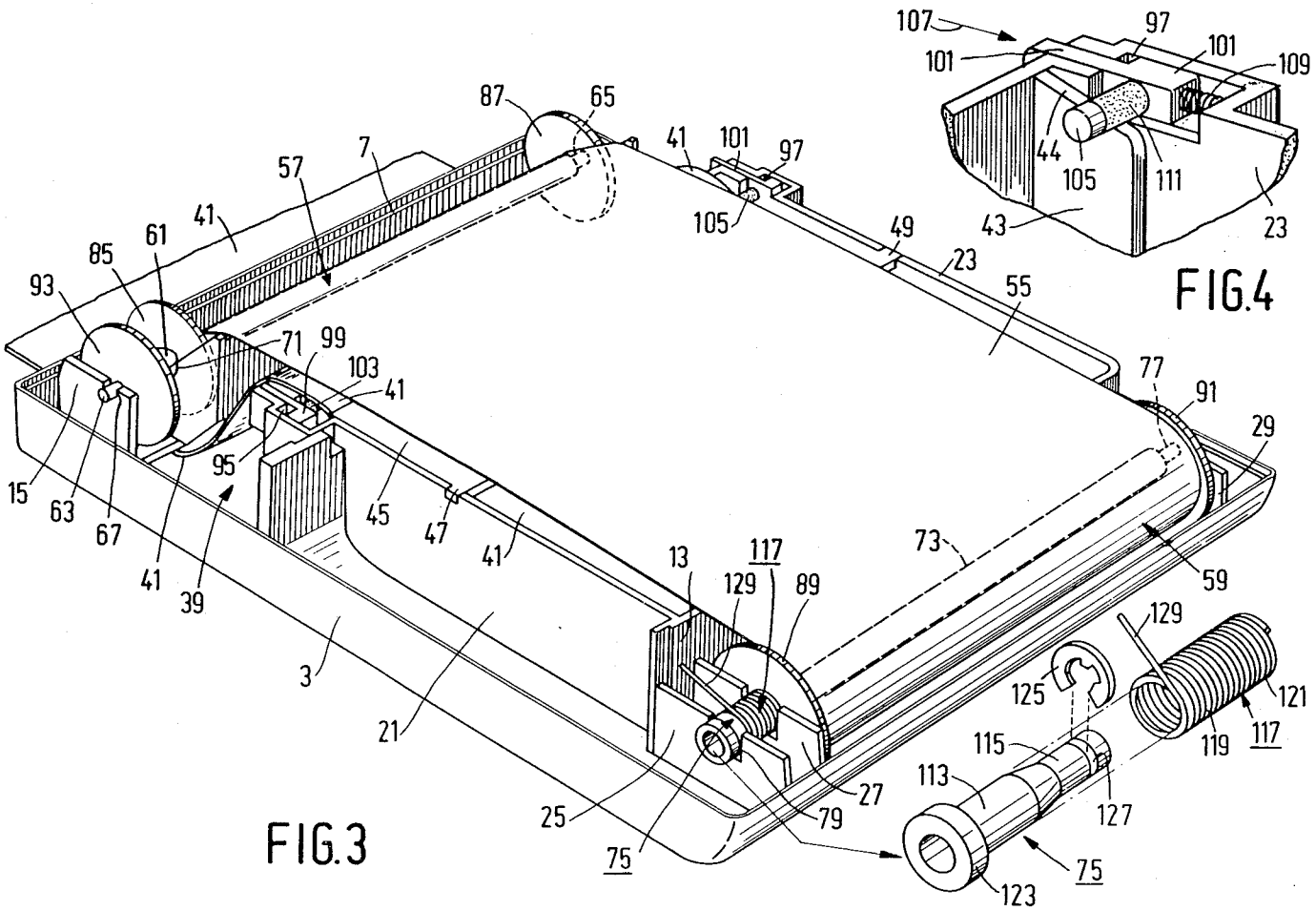
Figure 5:
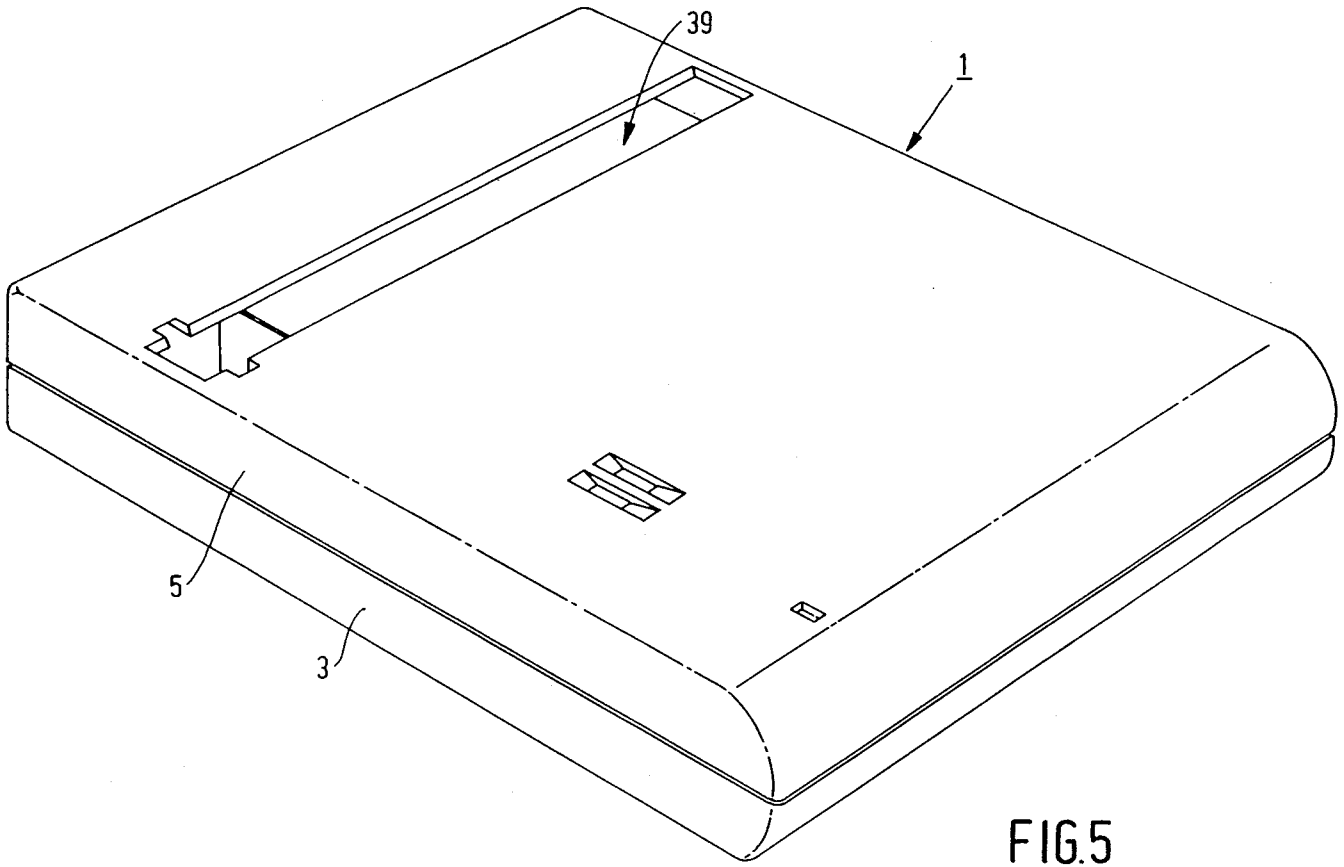
Figure 6:
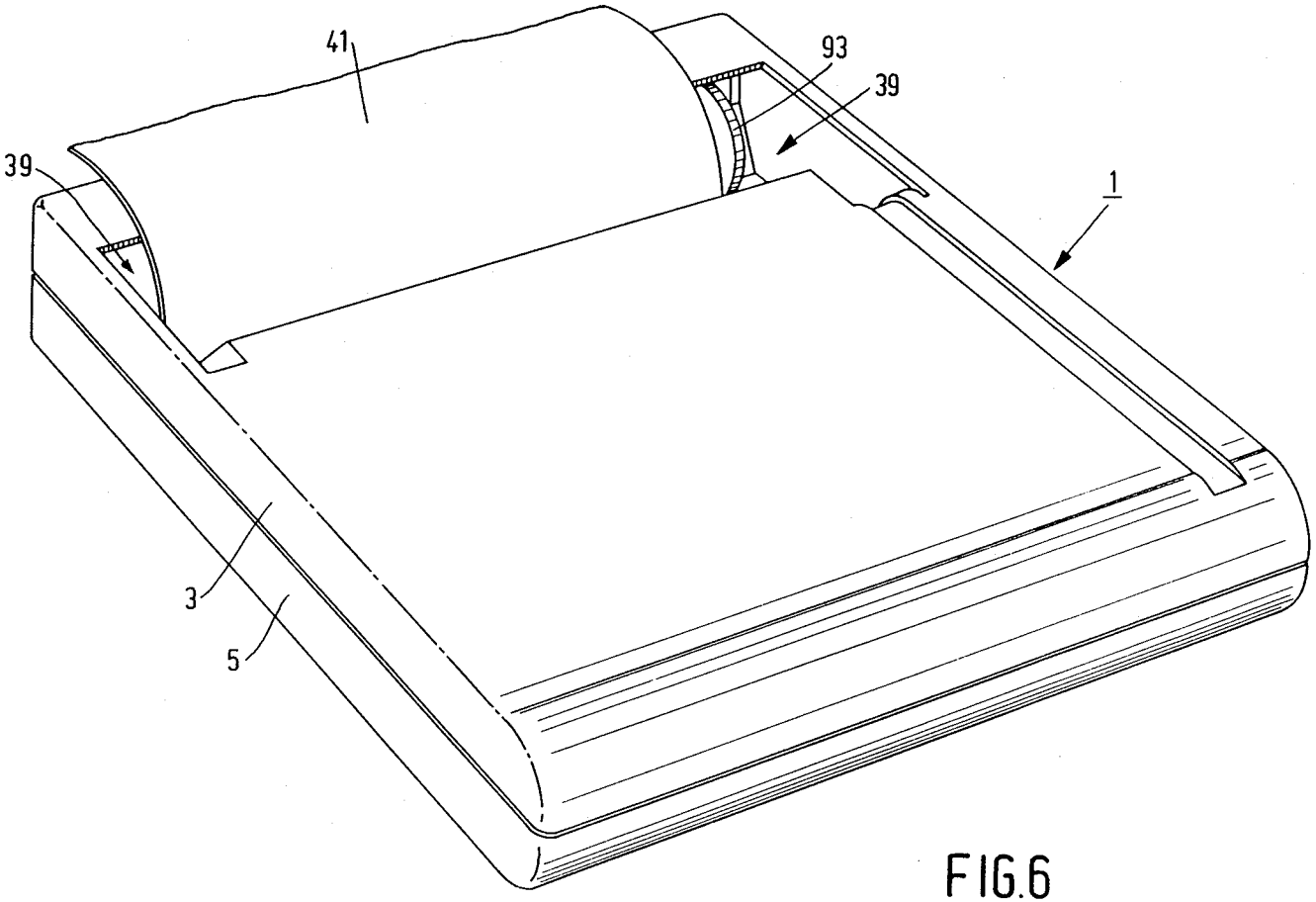
Figure 7:
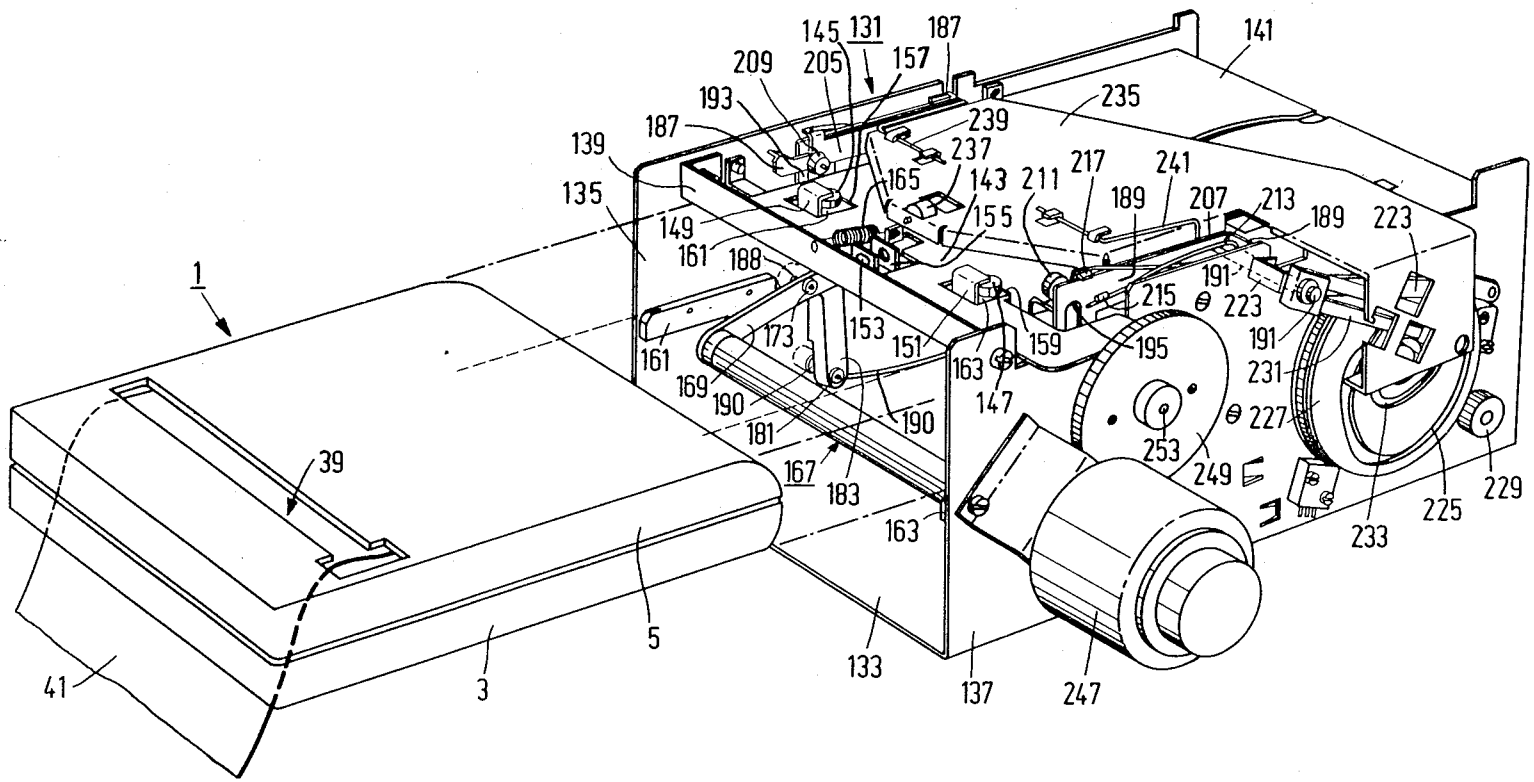
Figure 8:
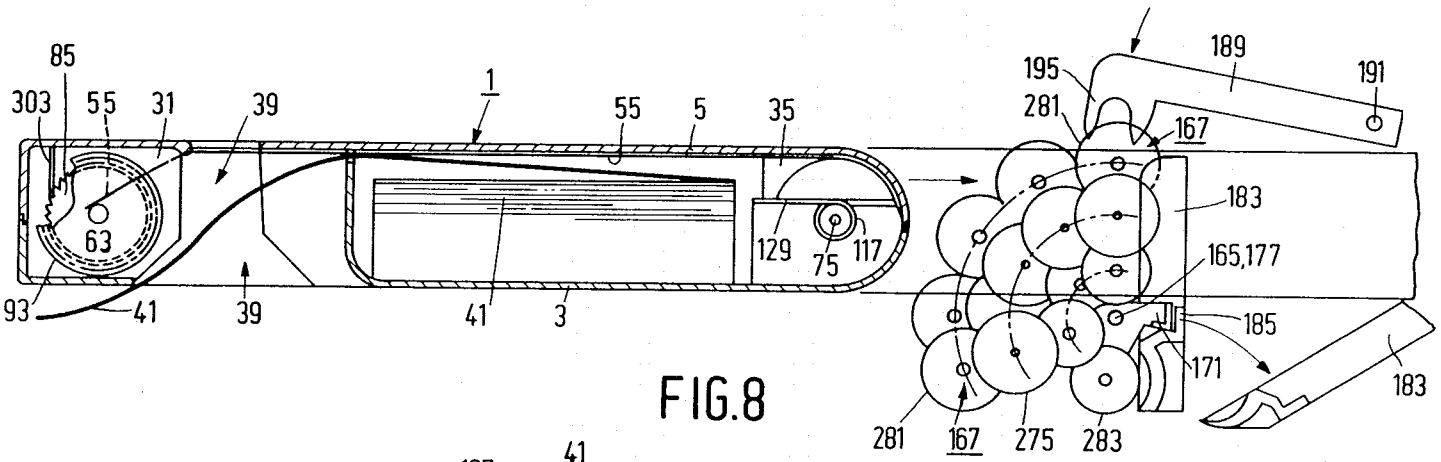
Figure 9:
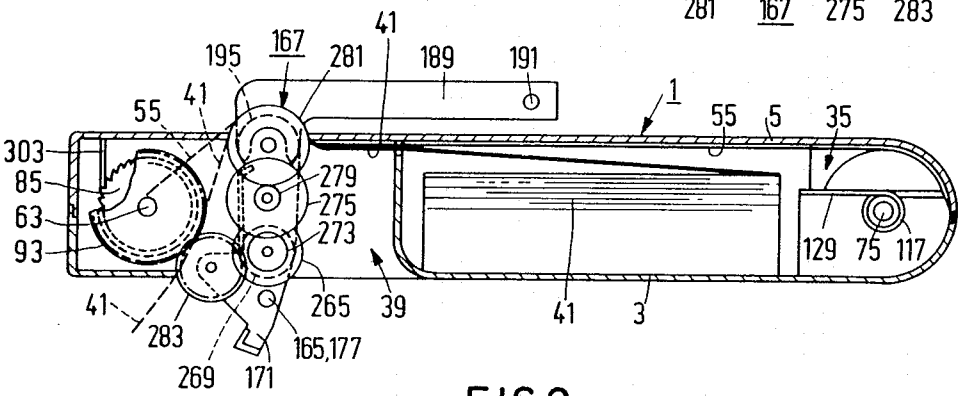
Figure 10:
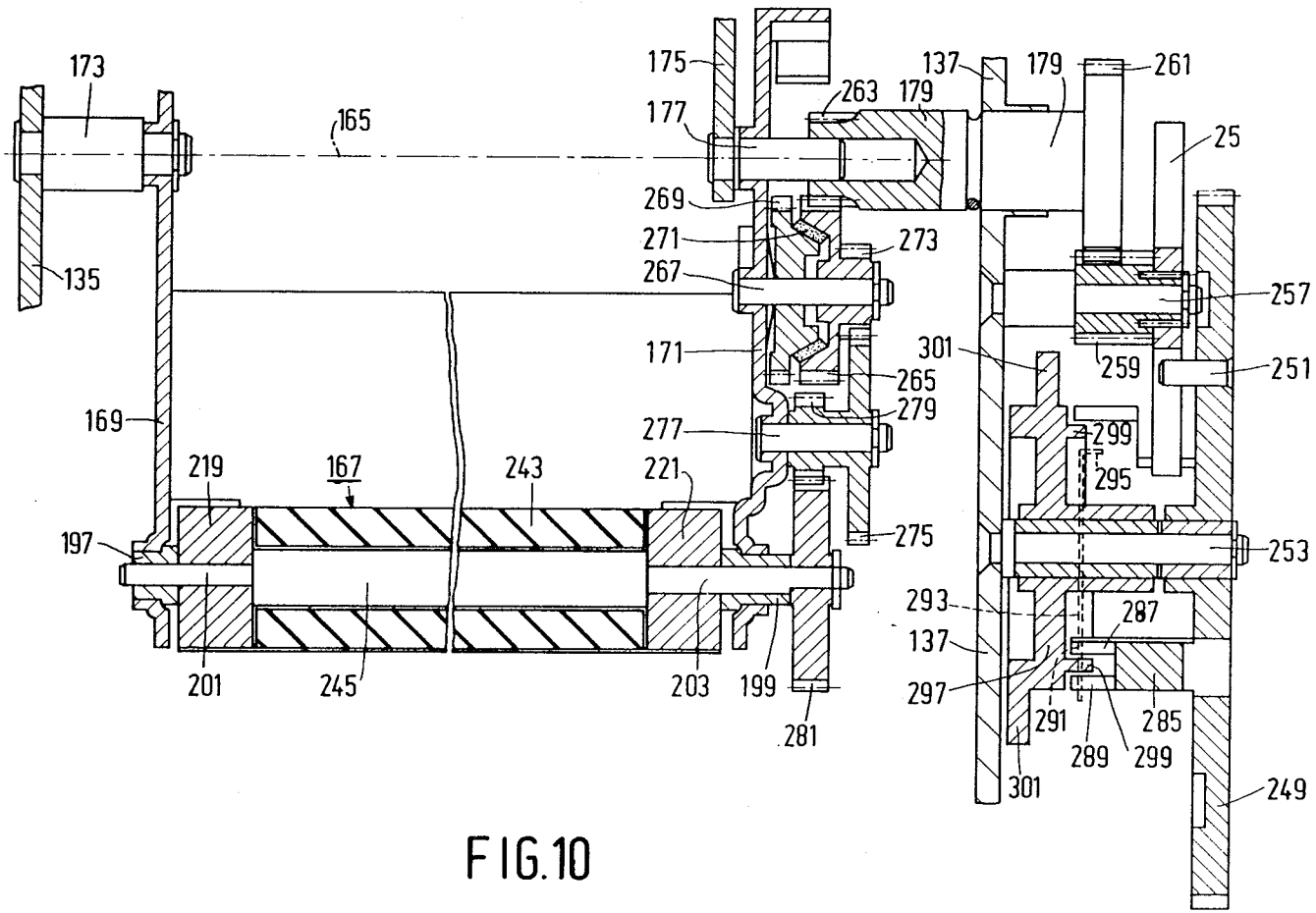
Figure 11:
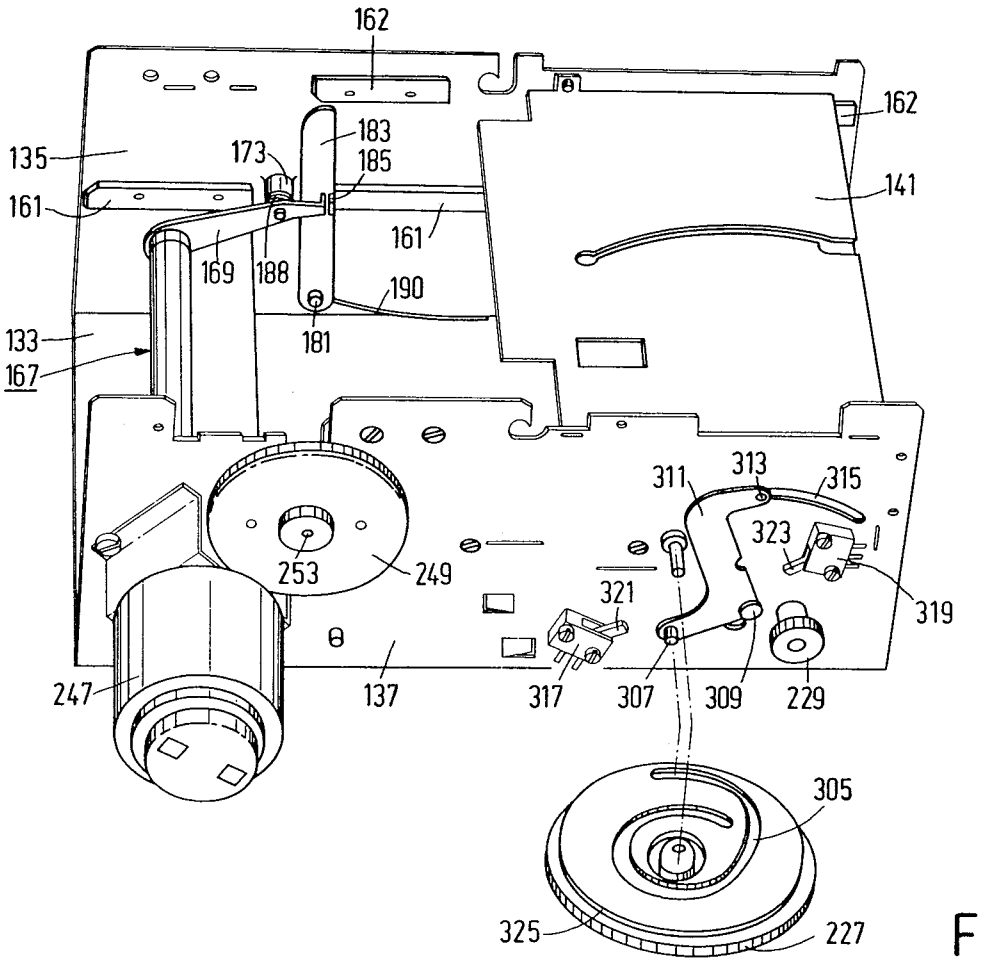

The invention will be described more fully with reference to the drawing, in which:

FIG. 1 is a perspective plan view of a lower half of the cassette without a data strip or transfer strip, FIG. 2 shows a cassette according to FIG. 1 with only a data strip, FIG. 3 shows a cassette according to FIG. 1 with both a data strip and a transfer strip as well as a stretching device for the transfer strip, FIG. 4 is a perspective view of a brake for the data strip used in a cassette as shown in FIGS. 1, 2 and 3, FIG. 5 is a perspective plan view of the cassette shown in FIG. 1, FIG. 6 is a perspective bottom view of the cassette shown in FIG. 1, FIG. 7 is a perspective view of the cassette shown in FIG. 1 just before the instant of insertion into a printer suitable for the cassette, FIG. 8 shows the cassette during the insertion into the printer, FIG. 9 shows the cassette after insertion into the printer, FIG. 10 is a sectional view of the drive for the data strip and a part of the drive for the transfer strip, FIG. 11 is a perspective plan view of an ejector mechanism for the cassette.

A cassette 1 illustrated in FIGS. 5 and 6 comprises a rectangular lower half 3 and a rectangular upper half 5 adjoining it. The two halves 3 and 5 may be detachably snap-connected to each other in a usual manner not shown further or may be permanently interconnected. Preferably, the cassette 1 is injection-moulded from synthetic material, such as, for example, acrylonitril butadiene styrene.

As appears from FIG. 1, the lower half 3 has a number of parallel transverse partition walls 7, 9, 11 and 13 as well as a number of parallel longitudinal partition walls 15, 17, 19, 21, 23, 25, 27 and 29. The transverse partition walls 7 and 9 together with the longitudinal partition walls 17 and 19 constitute a first rectangular chamber 31 adapted to receive a take-up reel for a transfer strip to be described below. The longitudinal partition walls 27 and 29 together with the transverse partition wall 13 and a curved end wall 33 constitute a second chamber 35 adapted to receive a supply reel for the said transfer strip to be described below. A third chamber 37 for a data strip to be described below is constituted by the transverse partition walls 11 and 13 and the longitudinal partition walls 21 and 23. There extends between the first chamber 31 and the third chamber walls 9, 11, in transverse direction a window 39, which is funnel-shaped (see also FIGS. 8 and 9), on the lower side of the cassette 1. The window 39 extends from the upper side of the cassette to the lower side of the cassette and thus forms an opening in the cassette accessible from two sides. FIG. 2 shows that the third chamber 37 is provided with a data strip 41. The data strip 41 is folded up in the chamber 37. The data strip 41 may consist of normal paper. From the third chamber 37, the data strip 41 is guided along the upper edge of the transverse partition wall 11 through the window 39 outside the cassette. The transverse partition wall 11 is provided with guide plates 43 which are arranged at right angles thereto and whose inclined upper edge 44 serves to guide the data strip 41. A further guide plate 45 (see FIG. 2) is positioned with lugs 47 and 49 in fitting recesses 51 and 53 (see FIG. 1) in the longitudinal partition walls 21 and 23 and further bears on the upper edges 44 of the plates 43. After the upper half 5 has been placed on the lower half 3, a complete cassette is obtained, which can be arbitrarily inserted into a black-and-white printer or into a printer to be described more fully, which can be used as a black-and-white printer or as a colour printer.

As appears from FIG. 3, the cassette can be provided in combination with the data strip 41 and a transfer strip 55. For this purpose, the first chamber 31 accommodates a take-up reel 57 and the second chamber 35 accommodates a supply reel 59. The take-up reel 57 has a shaft 61, which is rotatably journalled with stub shafts 63 and 65 in U-shaped recesses 67 and 69 in the longitudinal partition walls 15 and 19 (see FIGS. 1, 2 and 3). The longitudinal partition wall 17 is provided with a U-shaped recess 71, through which the shaft 61 is passed. The supply reel 59 has a shaft 73 which is rotatably journalled with stub shafts 75 and 77 in U-shaped recesses 79 and 81 in the longitudinal partition walls 25 and 29. The longitudinal partition wall 27 is provided with a U-shaped recess 83, through which the stub shaft 75 is passed. The stub shaft 75 is secured by means of a conventional pin assembly (not shown) to the shaft 73. The shaft 61 of the take-up reel 57 has two milled wheels 85 and 87, which are made in one piece with the shaft 61 of synthetic material, such as, for example, the injection-mouldable acrylinitril butadiene styrene. The shaft 73 also has two milled wheels 89 and 91, which are made in one piece with the shaft 73. The function of the milled wheels 85 and 87 on the shaft 61 will be explained more fully. The milled wheels 89 and 91 have no function. These milled wheels are present only for standardization and manufacture reasons. On the shaft 61 is further provided a gear wheel 93 which serves for externally driving the take-up reel 57. The drive of the take-up reel 57 will be explained more fully. There are formed in the longitudinal partition walls 21 and 23 chambers 95 and 97, respectively, for guiding slides 99 and 101, which are provided with frictional pins 103 and 105. FIG. 4 shows the operation of the slide 101, which is identical to the operation of the slide 99. When a force is exerted on the slide 101 in the direction of an arrow 107, this slide is displaced against the force of a helical spring 109. The pin 105 then slides downwards with friction over the upper edge 44 of the plate 43. Since the pin 105 is located below the data strip 41, the pin 105 will move upwards due to the reset force of the spring 109 when the force on the slide 101 is eliminated. The pin 105 is provided with a rubber sheath 111, which is pressed against the lower side of the data strip 41 along a narrow border thereof in the absence of the said force on the slide 101. The data strip is thus pressed against the lower side of the upper half 5 of the cassette (not shown in the Figures). The pin 105 solely engages along the narrow border of the data strip 41 because it is wider than the transfer strip 55 and it consequently acts as a brake for the data strip 41. The manner in which the slide 101 is operated will be explained more fully hereinafter. It is now stated already that the pin 105 only acts as a brake if the cassette 1 is situated outside a printer. Thus, the cassette is protected against unintended extraction of the data strip 41. The stub shaft 75 secured to the shaft 73 has a first part 113 having a comparatively large diameter and a second part 115 having a comparatively small diameter. The part 113 is surrounded by a helical spring 117 with a light sliding fit. The inner diameter of a first part 119 of the helical spring 117 is chosen so that this sliding fit is present when the spring is relieved. The inner diameter of the spring 117 in unrelieved condition of the spring is constant so that a second part 121 of the spring 117 is free from the second part 115 of the stub shaft 75. The spring 117 is enclosed between a shoulder 123 of the stub shaft 75 and a locking spring 125 provided in an annular groove 127 in the stub shaft 75. Furthermore, the spring has an end 129, which under given conditions engages the transverse partition wall 13. The operation of the spring 117 acting as a frictional coupling will be explained more fully hereinafter. It should be noted that the window 39 is formed so (see FIG. 6) that the gear wheel 93 can be brought into engagement with an external drive for the take-up reel 57 to be described more fully.

As stated, the cassette 1 is multifunctional, which means that the cassette can be used in printers of different kinds. The use of the cassette will now be described with reference to a particular printer, i.e. a colour printer. Since in the case of colour printing both a data strip and a colour transfer strip are required, the starting material is a cassette 1 which, as shown in FIG. 3, is provided with both strips.

FIG. 7 shows the cassette 1 at an instant just before the insertion into a colour printer 131. The colour printer 131 has a bottom 133 and two sidewalls 135 and 137 at right angles thereto. By means of a connection rod 139 and a connection plate 141, which are secured to the sidewalls 135 and 137, a rigid box construction is obtained. There extends parallel to the bottom 133 a plate-shaped printing head 143, which is provided on its lower side with a row of known thermal printing elements (not shown). The printing head 143 can perform a reciprocating translatory movement in a horizontal plane and for this purpose is guided by means of rollers 145 and 147 along L-shaped guides 149 and 151, which are secured to the connection rod 139. Furthermore, the printing head 143 is provided with upright lugs 153 and 155, in which a shaft is journalled with a further roller for the vertical guiding of the printing head 143 (not shown) over the connection rod 139 of L-shaped cross-section. The rollers 145 and 147 are guided on one side along the guides 149 and 151 and are guided on the other side along edges 157 and 159 of windows 161 and 163 in the printing head 143. A tensile spring 165 keeps the rollers 145 and 147 pressed against the guides 149, 151 and the edges 157 and 159. The sidewalls 135 and 137 are provided with parallel horizontal rails 161, 162 and 163 (see also FIG. 11) for guiding the cassette 1 in the printer 131. There is provided in the printer 131 a transport roller 167 rotatable about a shaft 165 (see FIGS. 7, 8, 10 and 11), which is rotatably journalled in levers 169 and 171 (see FIG. 10). For this purpose, the lever 169 is rotatable about a stub shaft 173 secured to the sidewall 135, while the lever 171 is rotatable about a stub shaft 177 secured to a frame plate 175. The stub shaft 177 is rotatable relative to a shaft 179, which is rotatably journalled in the sidewall 137. The transport roller 167 has a first final position (see FIG. 7) occupied before insertion of the cassette 1 and a second final position (see FIG. 8) occupied after insertion of the cassette. In the first final position shown in FIG. 7, the transport roller is locked by means of a lever 183 rotatable about a shaft 181 secured to the sidewall 135 (see also FIG. 11). Such a lever, which is rotatable about a shaft secured to a frame wall (not shown) is also present on the other side of the printer. The lever 183 is provided with a lug 185 which is engaged under resilient stress by the lever 169. The lever 169 is pre-stressed by a spring 188, while the lever 183 is pre-stressed by a spring 190. Both springs 188 and 190 are secured at one end to the respective lever and are secured at their other end to and supported from the sidewall 135 and the bottom 133, respectively. The springs 188 and 190 surround the shafts 173 and 181.

When the cassette 1 is inserted over the rails 161, 162 and 163, the front side of the cassette 1 presses in a first stage of the translation against the lever 183 and against the said other lever not shown in the drawing. Due to the fact that the lever 183 is pivoted about the shaft 181, the lug 185 becomes disengaged from the lever 169 so that the latter will be pivoted under resilient force about the shaft 165. The pivotable levers 169 and 171 carry the transport roller 167 upwards just at the instant at which the window 39 in the cassette is situated above the transport roller 167. When the cassette is inserted further into the printer, the transport roller 167 is pivoted entirely into the window 39. In the final position, the transport roller 167 slightly projects above the cassette, as is indicated in FIG. 8. During the final stage of the pivotal movement of the transport roller 167, the data strip 41 and the colour transfer strip 55 are pulled along by the transport roller 167 and are stretched around it. The transport roller 167 is fixed in the second final position shown in FIG. 8 by means of two levers 187 and 189 (see FIG. 7), which are rotable by means of a shaft 191. For this purpose, the levers 187 and 189 are provided with forks 193 and 195, which grip with right fit around bearing bushes 197 and 199 (see FIG. 10), in which stub shafts 201 and 203 of the transport roller 167 are rotatable. The bearing bushes 197 and 199 are secured in the levers 169 and 171. On their outer side, the forks 193 and 195 engage the upper edges of the window 39. Moreover, the respective outer sides of the forks 193 and 195 press the slides 99 and 101 against spring force backwards so that the frictional pins 103 and 105 become disengaged from the data strip 41. Thus, the brake on the data strip 41 is eliminated.

Summarizing, the forks 193 and 195 consequently have a threefold function, i.e.:

positioning the cassette 1 with respect to the printing head 143, positioning the transport roller 167 with respect to the printing head 143, eliminating the brake on the data strip 41.

There extend parallel to the levers 187 and 189 two further levers 205 and 207, which are rotatable about the shaft 191. Conical pressure rollers 209 and 211 are rotatably journalled in the levers 205 and 207. The levers 205 and 207 are rotable relative to the levers 187 and 189. This will be explained more fully with reference to the pair of levers 189 and 207. The same applies to the pair of levers 187 and 205. A pre-stressed wire spring 213 wrapped around the shaft 191 bears with a first end on a lug 215 on the lever 189 and bears with a second end on a lug 217 on the lever 207. Upon rotation of the shaft 191, the pairs of levers are pivoted together until the pressure rollers 209 and 211 will engage the data strip 41, which is wrapped around the transport roller 167 and is wider than the colour transfer strip 55. Until that instant, the lug 217 engages the upper edge of the lever 207. Upon further rotation of the shaft 191, the levers 187 and 189 are pivoted until the forks 193 and 195 grip with right fit around the bearing bushes 197 and 199, while the levers 205 and 207 are stationary because the pressure rollers 209 and 211 already press against the transport roller 167. The shaft 191 then rotates in the levers 205 and 207. The wire spring 213 is further stretched during the relative rotation of the levers 189 and 207. As shown in FIG. 10, disks 219 and 221 are secured on the stub shafts 201 and 203. The rubber pressure rollers 209 and 211 will engage the disks 219 and 221 which are provided with a rough surface. The shaft 191 has secured to it a lever 223 which is provided with a follower pin (not shown in FIG. 7). This follower pin is guided in a groove 225 of a gear wheel 227 rotatably journalled in the sidewall 137. The gear wheel 227 is driven by means of a D.C. motor (not shown) arranged in the printer via a pinion 229. Upon rotation of the gear wheel 227, the shaft 191 is consequently also rotated. A further lever 231 is rotatably journalled on the shaft 191. The lever 231 is also provided with a follower pin (not shown in FIG. 7), which is guided in a groove 233 of the gear wheel 227. Upon rotation of the gear wheel 227, the lever 231 freely rotates about the shaft 191. The lever 231 is coupled in a manner not shown to a pressure plate 235, in which a rotatable pressure roller 237 is journalled. After rotation of the gear wheel 227, the pressure roller 237 engages the printing head 143, as a result of which the printing elements located on the lower side of the printing head 143 are pressed against the colour transfer strip 55 wrapped around the transport roller 167. The pressure plate 235 is freely rotable about the shaft 192 and is held in place by two wire springs 239 and 241 supported against the shaft 191. The pressure of the printing elements on the printing head 143 by means of the pressure plate 235 is exerted after the pairs of levers 187, 205 and 189, 207 have already reached their final position before the beginning of the printing step. This is possible due to the fact that the groove 225 has a circular beginning part so that upon rotation of the gear wheel 227 the lever 231 is set into motion only after the relevant follower pin has left this circular part of the groove 225.

As appears from FIG. 10, the transport roller 167 is provided with a rubber sheath 243. This sheath 243 is freely rotatable about a shaft 245, of which the stub shafts 201 and 203 form part. The width of the colour transfer strip 55 is equal to the width of the sheath 243. At the instant at which the disks 219 and 221 engage the data strip 41 and the conical pressure rollers 209 and 211, respectively, the rubber sheath 243 also engages the colour transfer strip 55 and the printing elements on the lower side of the printing head 143. The printer 131 is of the type in which the data strip 41 and the colour transfer strip 55 are displaced intermittently over a distance which is equal to the distance between two successive lines with image points in the image to be printed. During the stationary condition of the two strips, the printing head 143 is transported each time once forwards and backwards, the thermal printing elements moving with friction along the colour transfer strip 55. Colour material is transported from the colour transfer strip 55 to the data strip 41 by energization and heating of the printing elements during the forward stroke of the printing head 143. During the backward stroke of the printing head 143, there is no printing.

By means of a D.C. motor 247 (see FIGS. 7, 10 and 11), a gear wheel 249 is driven, which is provided with a follower pin 251. The gear wheel 249 is rotatable about a shaft 253 secured to the sidewall 137 (see FIG. 10). The follower pin 251 meshes periodically with a known Genova mechanism 255, which is rotatable about a shaft 257 secured to the sidewall 137. The Genova mechanism 255 has secured to it a gear wheel 259 which is rotatable about the shaft 257 and which meshes with a gear wheel 261 on the shaft 179, which is rotably journalled in the sidewall 137. The shaft 179 is also provided with a gear wheel 263, which is rotatable in the stub shaft 177 inserted into it and meshes with a gear wheel 265. The gear wheel 265 is rotable about a shaft 267 secured to the sidewall 137. A frictional ring 271 is arranged between the gear wheel 265 and a gear wheel 269 rotatable about a shaft 267. The gear wheel 265 is integral with a gear wheel 273, which meshes with a gear wheel 275, which is rotatable about a shaft 277 secured to the sidewall 137. The gear wheel 275 is integral with a gear wheel 279, which meshes with a gear wheel 281 secured on the stub shaft 203. It appears from FIG. 9 that the gear wheel 269 still meshes with a gear wheel 283 which is rotatably journalled in the lever 171 and which, when the transport roller 167 has been pivoted, meshes with the gear wheel 93 on the take-up reel 57 of the cassette 1 (see also FIG. 3). As is shown in FIG. 10, the gear wheel 249 is integral with a first coupling half 285, which is provided with lugs 287 and 289. The lugs 287 and 289 are provided with slotted holes (not shown), through which an end 291 of a wire spring 293 is inserted, which is hooked by another end 295 into the first coupling half 285. A second coupling half 297 is provided with a first cam 299 and a second cam 301. Upon rotation of the gear wheel 249 in a first direction, the spring 293 hooks behind the first cam 299 and takes along the second coupling half 297. Upon rotation of the gear wheel 249 in a second direction opposite to the first direction, the end 291 of the spring 293 runs over the first cam 299 whilst simultaneously being displaced in the slotted holes of the lugs 287 and 289. Thus, a freewheel coupling is consequently obtained. Cam follower rollers (not shown), which are rotatably journalled on the printing head 143, run over the second cam 301 on the second coupling half 297. Thus, the reciprocating movement of the printing head 143 is obtained.

The operation of the cassette 1 in a printing process with the printer 131 will be described hereinafter, it being assumed that the cassette 1 is inserted and positioned by the forks 193 and 195 and that the pressure plate 235 keeps the printing head 143 pressed against the data strip 41 and colour transfer strip 55 arranged around the transport roller 167. The gear wheel 249 and hence the first coupling half 285 is driven by the motor 247. It is assumed that the direction of rotation of the gear wheel 249 is such that the spring 293 is hooked behind the cam 299, as a result of which the second coupling half 297 is set into rotation. The afore-mentioned cam follows rollers (not shown) rotatably journalled on the printing head 143 then roll off over the cam 301 so that a reciprocating movement is imposed on the printing head 143. During the reciprocating translatory movement of the printing head 143, the data strip 41 and the colour transfer strip 55 are stationary because at that instant the pin 251 on the gear wheel 249 does not mesh with the Genova mechanism 255. By energization in a usual manner of the thermal printing elements on the lower side of the printing head 143, a row of points of the image to be produced is printed on the data carrier 41 during the first forward stroke of the printing head. The image points of the first row have the colour yellow and are formed by transfer-melting a small quantity of yellow wax from a rectangular field of yellow wax on the lower side of the colour transfer strip 55. After the printing head 143 has returned to the starting position, the two strips 41 and 55 are transported over a line distance of the image to be produced. When the gear wheel 249 is rotated further, the pin 251 in fact again meshes with the Genova mechanism 255, as a result of which a step rotation of the gear wheel 259 is obtained. Via the gear wheels 261 and 263, the gear wheel 265 now also rotates through one step. The gear wheel 265 belongs to a first gear wheel train, to which further belong the gear wheels 273, 275, 279 and 281 so that the transport roller 167 also rotates through one step. The pressure rollers 209 and 211 press the data strip 41 at the sides against the two disks 219 and 221, which in the first instance ensure that the data strip 41 is transported. The colour transfer strip 55 is transported by the take-up reel 57 in the cassette 1. The sheath 243 consequently has no direct transport function, but serves to press the two strips against the printing head 143. In the second instance the transport of the data strip 41 is obtained by the frictional force exerted by the colour transfer strip 55 on the data strip 41. It should be noted that the friction between the two strips is larger than the friction between the colour transfer strip 55 and the printing elements on the lower side of the printing head. The gear wheel 265 also belongs to the second gear wheel train so that the take-up reel 57 for the colour transfer strip 55 is rotated stepwise. For this purpose, the frictional ring 271, which exerts a drive torque on the gear wheel 269, is arranged between the gear wheel 265 and the gear wheel 269. As appears from FIG. 9, the gear wheel 269 meshes with the gear wheel 283, which in turn meshes with the gear wheel 93 secured to the take-up roller 57. Consequently, the gear wheels 265, 269, 283 and 93 belong to the second gear wheel train. The ratio between the transmissions of the first and the second gear wheel train is chosen so that even at the beginning of the operation of winding the colour transfer strip 55 onto the take-up reel 57, the circumferential speed thereof would be slightly higher than the circumferential speed of the disks 219 and 221 if no slip should occur between the frictional ring 271 and the gear wheel 269. Actually, slip occurs between the frictional ring 271 and the gear wheel 269 because the diameter over which the frictional ring 271 engages the gear wheel 269 is smaller than the diameter over which the frictional ring 271 engages the gear wheel 265.

The slipping speed of the frictional ring 271 over the gear wheel 269 increases as the diameter of the take-up reel 57 increases. Thus, it is therefore ensured that per unit time equal lengths of the strips 41 and 55 are transported along the printing elements on the printing head 143 with an increasing winding diameter of the take-up reel 57. The frictional force of the frictional ring 271 on the gear wheel 269 is always such that the colour transfer strip 55 is kept taut between the transport roller 167 and the take-up reel 57. Due to the fact that the colour transfer strip 55 is kept taut, it is also ensured that the strips 41 and 55 are drawn apart in the case in which adherence occurs between the strips during transport and drying of the wax to and on the data strip 41. The part of the data strip 41 between the transport roller 167 and the supply reel 59 (see FIG. 3) is kept taut by means of a stretching device, which is constituted by the spring 117 and the stub shaft 75. When the take-up reel 57 is driven, the part 119 of the spring 117 is effectively wound onto the part 113 of the stub shaft 75. Thus, a light clamping of the part 119 of the spring 117 on the part 113 of the stub shaft 75 is obtained so that a constant frictional torque is exerted on the supply reel 59. The end 129 of the spring 117 then bears on the transverse partition wall 13. When the drive of the take-up reel 57 is stopped and the cassette 1 is removed from the printer 131, the spring 117 is stretched and thus tautens the bulge in the colour transfer strip 55 produced by the transport roller 167. After the data strip 41 has been transported along the printing head 143 over a distance which is equal to the distance between two successive rows of printed points in the base colour yellow, the pin 251 does not mesh with the Genova mechanism 255 and the transport of the two strips has stopped. The next line of points in the colour yellow is now printed with a continued rotation of the gear wheel 249. The shape of the cam 301 is such that the printing head 143 starts a next reciprocating translatory movement just after the transport of the strips 41 and 55 has stopped. In the manner described, all the next lines of image points in the colour yellow are printed. The printing process takes place only during the forward translations of the printing head 143. The data strip 41 is provided at the beginning of each image field with a marker which is detected by a suitable first detector. The colour transfer strip 55 is provided at the beginning of each yellow field of wax with a marker which is detected by a suitable second detector. At the beginning of the printing process, the two markers were consequently located opposite to the respective detectors. After all the lines of image points in the colour yellow have been printed, the two strips are transported further over a given distance. This distance is chosen so that it is ensured that the next field of wax in the second base colour magenta is located opposite to the printing elements. The motor 247 is automatically stopped after transport of the two strips over the said distance. Therefore, it is not necessary that markers are detected. Subsequently, by means of the motor arranged in the printer, the gear wheel 227 is driven in a direction opposite to that for activating the pressure plate 235. The pins on the levers 223 and 231 run in the grooves 225 and 233, respectively. Because the pin on the lever 231 follows the groove 233, this pin traverses a track having a radius of gradually decreasing value so that the pressure plate 235 is lifted. The lever 231 then rotates about the shaft 191. However, the pin on the lever 223 follows a track having a constant radius because the beginning part of the groove 225 is circular. The last-mentioned pin therefore continues to occupy a fixed position so that the lever 223 and the shaft 191 are not rotated either. The drive of the gear wheel 227 is stopped before the pin on the lever 223 leaves the circular part of the groove 225. The positioning of the transport roller 167, the cassette 1 and the pressure rollers 209 and 211 is therefore maintained. Subsequently, the gear wheel 249 is driven by the motor 247 in a direction opposite to the direction of rotation corresponding to the transport of the two strips 41 and 55 over the image line distance, as already described. This means that the spring 293 will run over the cam 299 so that the coupling halves 285 and 297 are disengaged and the coupling half 297 is stationary. The printing head 143 is therefore not driven in this stage. The transport of the colour transfer strip 55 is blocked by a leaf spring 303 which engages the milled wheel 85 (see FIGS. 8 and 9). The leaf spring 303 and the milled wheel 85 consequently act as a blocking device. Thus, the frictional ring 271 will slip over the now stationary gear wheel 269. The data strip 55 is transported in a number of steps intermittently back to the starting position, which is recognized by means of the first detector. This detector supplies a stopping signal for the motor 247 at the instant at which the aforementioned marker on the data strip 41 is detected. Since the field of wax of the second base colour magenta of the colour transfer strip 55 is already located below the printing elements, printing of the image points in the colour magenta can now be started after the pressure plate 235 has first been pressed by means of the gear wheel 227 against the printing head 143. The image points in the colour magenta are now printed over the image points already printed in the colour yellow. After all the image points in the colour magenta have been printed, the image points in the third base colour cyan are printed in an analogous manner. As the case may be, image points in the colour black are also printed. The various colour shades of the image points containing wax of the three different base colours are obtained by varying the quantities of wax that are transferred. This may be effected in a usual manner by supplying to the printing elements on the printing head 143 control signals whose pulse width is modulated. After the complete image has been printed, a next image can be printed on the data carrier. The part of the data carrier with the image already printed may alternatively be torn off. The length of the two strips is such that a number of images can be printed successively. If desired, the cassette 1 may be removed from the printer 131.

As appears from FIG. 11, the gear wheel 227 is provided with a third groove 305, which forms a guide for a third follower pin 307, which is secured to a lever 311 journalled in the sidewall 137 so as to be rotatable about a shaft 309. The groove 305 is located on the side of the gear wheel 227 facing the sidewall 137. The lever 311 has secured to it an ejector pin 313, which is guided in a slot 315 in the sidewall 137. When the cassette 1 is inserted, the ejector pin 313 engages the front side of the cassette (not shown in the Figures). When the gear wheel 227 is rotated, the cassette 1 can consequently be moved over a given length out of the printer by means of the ejector pin 313. The cassette can then be removed by hand. The sidewall 137 of the printer has secured to it two microswitches 317 and 319, of which switching cams 321 and 323 engage a cam 325 on the gear wheel 227. The switches 317 and 319 serve to limit the rotations of the gear wheel 227 in both directions of rotation.

Whilst maintaining the principle of a pivotable transport roller for the transport of the data strip described above with reference to a particular embodiment of a printer, a number of alternatives are possible. In fact, the cassette described and the printer are both multifunctional. This means that the cassette and the printer are suitable for both black-and-white printing and colour printing. In the case of black-and-white printing, there are two possibilities, i.e.:

printing with a combination of a data strip and a colour strip only containing the colour black, printing with solely a data strip.

In both cases, it is no longer necessary for the data strip to be transported back. If only a data strip is used, the cassette of course only comprises a data strip. The latter can consist of heat-sensitive paper if the printing head 143 comprises thermal printing elements as in the present case. The printing head 143 may be of a quite different type, however. Suitable printing heads are, for example, electrostatic printing heads, printing heads with impact elements, such as printing pins, printing heads working with ink-drop generators, magnetic printing heads and optical printing heads working with a photosensitive layer on the data carrier. Such printing heads and the data strips used therein are known per se. Furthermore, a data strip with a heat-sensitive layer may be used, in which a colour change is brought about by thermal printing elements. The transport of the data strip and/or transfer strip may be effected both intermittently and continuously. The printing head may also be fixedly arranged. With the use of thermal printing elements, a comparatively large number of comparatively small printing elements is then required.

Although the cassette has been described with reference to a printer with a printing principle, according to which the points of different base colours are printed over each other, other configurations of the points in different base colours may also be chosen. The points may be printed both in a triangular configuration and in a line configuration. Such configurations are known per se. The third chamber may be located on the front side of the cassette, while the second chamber is located between the first and the third chamber and between the window and the third chamber. In this case, the data strip is guided along the lower side of the supply reel. The end of the data strip may then be guided to the outside through a slot on the back side of the cassette. Since the third chamber is now not located between the first and the second chamber, the supply reel and the take-up reel can be arranged in a separate cassette, which is arranged in the cassette.

The cassette can be used in printers in which the transport roller is not pivotable, but may perform a translation into the window of the cassette. The printing head can also perform such a translation.

What is claimed is:

1. A multifunctional cassette for a printer comprising a first chamber in which a cylindrical take-up reel can be journalled for rotation on an axis and a second chamber in which a cylindrical supply reel can be journalled for rotation on an axis parallel to the axis of said take-up reel, said cassette including a window which is located between the first and the second chambers and extends from a first cassette side to an opposite second cassette side thereby forming an opening in the cassette which is accessible from outside said cassette on each of said two sides, said cassette also including a third chamber for storing a data strip with a flat surface and two side edges and a releasable brake means for said data strip, said brake means being accessible for release through said window, said brake means including an elongated pin located at each side edge of said data strip stored in said third chamber, each said pin having a frictional surface, each said pin for engaging with its frictional surface said data strip stored in said third chamber along a narrow border on the flat surface thereof along an associated side edge.

2. A cassette as claimed in claim 1 wherein said third chamber is located between said window and said second chamber, said third chamber having a supply of a fold-up data strip which projects to the outside of said cassette through said window.

3. A cassette as claimed in claim 2 wherein each said elongated pin is associated with a spring and a slide which is movable by compressing said spring, each said slide being connected to its associated elongated pin.

4. A cassette as claimed in claim 2 wherein a take-up reel is rotatably journalled in said first chamber and a supply reel is rotatably journalled in said second chamber, said second chamber having a supply of a transfer strip which is guided past said window from said supply reel to said take-up reel in a take-up direction wherein a stretching device is coupled to said supply reel for stretching said transfer strip and a blocking device prevents said take-up reel from turning in a direction opposite to said take-up direction.

5. A cassette as claimed in claim 4 wherein said take-up reel includes a gear wheel which is accessible through an opening in the cassette.

6. A cassette as claimed in claim 4 wherein a shaft is secured to said supply reel and said stretching device is a frictional coupling which comprises a helical spring slipped over said shaft secured to said supply reel, said helical spring having a first end bearing on a wall in said cassette and a second end, said shaft having a first part and a second part, said first part having a comparatively large diameter for engaging said helical spring on its inner side, said second part of said shaft having a comparatively smaller diameter than said first part whereby said second part is out of engagement with the inner diameter of said helical spring.

* * * * *